US007081168B2

(12) United States Patent
Voges

(10) Patent No.: US 7,081,168 B2
(45) **Date of Patent: *Jul. 25, 2006**

(54) METHOD OF REMOVING SCALE AND INHIBITING OXIDATION AND PRE-PAINTING SHEET METAL

(75) Inventor: Kevin C. Voges, Red Bud, IL (US)

(73) Assignee: The Materials Works, Ltd., Red Bud, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/983,351

(22) Filed: Nov. 8, 2004

(65) Prior Publication Data

US 2005/0132551 A1 Jun. 23, 2005

Related U.S. Application Data

(63) Continuation-in-part of application No. 10/408,732, filed on Apr. 7, 2003, now Pat. No. 6,814,815.

(51) Int. Cl.
*B08B 1/00* (2006.01)
*B08B 1/02* (2006.01)

(52) U.S. Cl. ..... 134/9; 134/6; 134/15; 134/42; 72/40

(58) Field of Classification Search ..... 134/6, 134/9, 15, 42; 72/40
See application file for complete search history.

(56) References Cited

U.S. PATENT DOCUMENTS

| | | | |
|---|---|---|---|
| 2,318,432 | A | 5/1943 | Stanier et al. |
| 2,449,507 | A | 9/1948 | Pope |
| 2,907,151 | A | 10/1959 | Peterson |
| 3,686,921 | A | 8/1972 | Roper |
| 3,722,251 | A | 3/1973 | Withrow |
| 3,753,522 | A | 8/1973 | Voges |
| 3,924,428 | A | 12/1975 | Noe |
| 4,312,325 | A | 1/1982 | Voges et al. |
| 4,539,830 | A | 9/1985 | Noe |
| 4,751,838 | A | 6/1988 | Voges |
| 4,872,245 | A | 10/1989 | Kawasaki |

(Continued)

FOREIGN PATENT DOCUMENTS

| | | |
|---|---|---|
| DE | 1452957 | 4/1969 |

(Continued)

OTHER PUBLICATIONS

3M Scotch-Brite Product Brochure, 1993.

(Continued)

*Primary Examiner*—Zeinab El-Arini
(74) *Attorney, Agent, or Firm*—Thompson Coburn LLP

(57) ABSTRACT

A method of removing iron oxide scale and coating sheet metal bonds a pre-paint to a wustite layer of the sheet metal. The iron oxide scale on the sheet metal generally comprises three layers prior to surface conditioning: a wustite layer, a magnetite layer, and a hematite layer. The wustite layer is bonded to a base metal substrate of the sheet metal. The magnetite layer is bonded to the wustite layer, and the hematite layer is bonded to the magnetite layer. Conditioning the surface of the sheet metal includes bringing a surface conditioning member into engagement with the surface of the sheet metal in a manner to remove substantially all of the hematite and magnetite layers from the surface, and in a manner to remove some but not all of the wustite layer from the surface. The portion of the wustite layer that remains bonded to the base metal substrate of the sheet metal protects the surface from oxidation until the surface is coated.

17 Claims, 5 Drawing Sheets

U.S. PATENT DOCUMENTS

| | | | |
|---|---|---|---|
| 4,887,502 | A | 12/1989 | Voges |
| 4,982,593 | A | 1/1991 | Holloway |
| 5,077,887 | A | 1/1992 | Holloway |
| 5,181,411 | A | 1/1993 | Holloway |
| 5,579,658 | A | 12/1996 | Noe |
| 5,759,307 | A | 6/1998 | Berger |
| 5,820,704 | A | 10/1998 | Veyer |
| 5,829,287 | A | 11/1998 | Noe |
| 6,088,895 | A | 7/2000 | Nelson et al. |
| 6,089,063 | A | 7/2000 | Noe et al. |
| 6,205,830 | B1 | 3/2001 | Voges |
| 6,210,501 | B1 | 4/2001 | Okano et al. |
| 6,732,561 | B1 | 5/2004 | Voges |
| 6,814,815 | B1 * | 11/2004 | Voges ..... 134/9 |
| 6,887,590 | B1 * | 5/2005 | Zeizinger et al. ..... 428/659 |

FOREIGN PATENT DOCUMENTS

| | | |
|---|---|---|
| EP | 0498038 | 8/1992 |
| JP | 58-116902 | 7/1983 |
| RU | 0158862 | 11/1963 |

OTHER PUBLICATIONS

Leveltek International, LLC website information, Circa 1999.

* cited by examiner

METHOD OF REMOVING SCALE AND INHIBITING OXIDATION AND PRE-PAINTING SHEET METAL

This patent application is a continuation-in-part application of patent application Ser. No. 10/408,732, which was filed on Apr. 7, 2003, now U.S. Pat. No. 6,814,815.

FIELD OF THE INVENTION

The present invention relates generally to methods for removing iron oxide scale from sheet metal and inhibiting further oxidation and pre-painting the sheet metal. More particularly, the present invention relates to methods for removing iron oxide scale from the surfaces of processed sheet metal using a mechanical surface conditioning apparatus in a manner to inhibit further oxidation on the conditioned surfaces and to reduce surface roughness, and for pre-painting the treated sheet metal.

BACKGROUND OF THE INVENTION

Processed sheet metal has a wide variety of applications. For example, aircraft, automobiles, file cabinets and household appliances, to name only a few, contain sheet metal bodies or shells. The sheet metal is typically purchased directly from steel mills and/or steel service centers, but may be passed through intermediate processors (sometimes referred to as "toll" processors) before it is received by an original equipment manufacturer. Sheet metal is typically formed by hot rolling process and, if the gauge is thin enough, it is coiled for convenient transport and storage. During the hot rolling process, carbon steel typically reaches finishing temperatures well in excess of 1500° F. (815° C.). Once the hot rolling process is completed, the hot rolled steel is reduced to ambient temperature, typically by quenching in water, oil or polymer, as is well known in the art. As a result of reactions with oxygen in the air and moisture, an iron oxide layer (or "scale") is formed on the surface of hot rolled carbon steel while the steel is cooled. The rate at which the product is cooled, and the total temperature drop, will affect the amount and composition of scale that forms on the surface during the cooling process.

Iron has a complex oxide structure with FeO ("wustite") mechanically bonded to the base metal substrate, followed by a layer of $Fe_3O_4$ ("magnetite") chemically bonded to the wustite, and then a layer of $Fe_2O_3$ ("hematite") chemically bonded to the magnetite and which is exposed to the air. Oxidation tends to progress more rapidly at higher temperatures, such as those reached in a typical hot rolling process, resulting in the formation of wustite. The relative thickness of each of the distinct wustite, magnetite and hematite layers is related to the availability of free oxygen and iron as the hot rolled substrate cools. When cooled from finishing temperatures above 1058° F. (570° C.), the oxide layer will typically comprise at least 50% wustite, and will also comprise magnetite and hematite in layers, formed in that order from the substrate. Though a number of factors (e.g., quenching rate, base steel chemistry, available free oxygen, etc.) affect the relative thicknesses of wustite, magnetite and hematite, as well as the overall thickness of the oxide layer, research has shown that the overall thickness of the oxide layer (inclusive of all three of these layers) in hot rolled carbon steel will typically be about 0.5% of the total thickness of the steel sheet. Thus, for example, in ⅜" hot rolled carbon steel, the overall thickness of the oxide layer will be about 0.002".

Various methods exist for flattening sheet metal and for conditioning the surfaces thereof. Flatness of sheet metal is important because virtually all stamping and blanking operations require a flat sheet. Good surface conditions are also important, especially in applications where the top and/or bottom surfaces of the metal sheet will be painted or otherwise coated. For processed sheet metal that is to be painted or galvanized, current industry practice is to remove all evidence of oxide from the surface to be painted or galvanized. With respect to painted surfaces, removing all evidence of oxide before painting ensures optimum adhesion, flexibility, and corrosion resistance of the intended paint coating layer. With respect to galvanizing, removing all evidence of oxide before coating allows a sufficient chemical bond of zinc to base metal.

The most common method of removing all oxide from the surface of hot rolled sheet metal before coating is a process known as "pickle and oil." In this process, the steel (already cooled to ambient temperature) is uncoiled and pulled through a bath of hydrochloric acid (typically about 30% hydrochloric acid and 70% water) to chemically remove the scale. Then, after the scale has been removed, the steel is washed, dried, and immediately "oiled" to protect it from rust damage. The oil provides an air barrier to shield the bare metal from exposure to air and moisture. It is critical that the metal be oiled immediately after the pickling process, as the bare metal will begin to oxidize very quickly when exposed to air and moisture. The "pickle and oil" process is effective in removing substantially all of the oxide layer, including the tightly bonded wustite layer, and results in a surface that is suitable for most coating applications. However, the "pickle and oil" process has a number of disadvantages. For example, the oil applied to the metal after pickling must be removed before the sheet metal can be pre-painted or coil coated, which is time consuming. Also, hydrochloric acid is an environmentally hazardous chemical, which has special storage and disposal restrictions. In addition, the oil coating interferes with some manufacturing processes, such as welding, causes stacked sheets to stick together, and gets into machine parts during manufacturing processes. Also, while the pickling process is effective at removing substantially all of the oxide layer, resulting in a surface that is suitable for most coating applications, the pickling agent (hydrochloric acid) tends to leave a clean but slightly coarse surface.

Thus, there is a need for an improved method of surface conditioning processed sheet metal, which removes enough scale from the surface to ensure optimum conditions for accepting coatings, such as pre-painting or coil coating, which results in a clean smooth surface that is suitable for virtually all coating applications, which includes a means for inhibiting further oxidation prior to coating, and which is less expensive and troublesome than standard pickling and oiling.

SUMMARY OF THE INVENTION

It is therefore an object of the present invention to provide an improved method of removing iron oxide scale from processed sheet metal in a manner to ensure optimum surface conditions for accepting paint, galvanizing, or other coating. A related object is to provide an improved method of removing iron oxide scale from processed sheet metal, which results in a smooth surface that is suitable for virtually all coating applications. Another object is to provide an improved method of removing iron oxide scale from processed sheet metal in a manner that will inhibit further oxidation without the need to coat with oil. Still another general object is to provide an improved method of removing iron oxide scale from processed sheet metal, which is less expensive and troublesome than standard pickling and oiling, and then pre-painting or coil coating the treated sheet metal.

The present invention includes methods of removing iron oxide scale from processed sheet metal, wherein the iron oxide scale generally comprises three layers: a wustite layer, a magnetite layer, and a hematite layer. The wustite layer is bonded to a base metal substrate of the processed sheet metal. The magnetite layer is bonded to the wustite layer, and the hematite layer is bonded to the magnetite layer. In general, the methods comprise the steps of: providing a surface conditioning apparatus; conditioning a surface of the processed sheet metal with the surface conditioning apparatus, and then pre-painting the conditioned surface. The surface conditioning apparatus has at least one surface conditioning member. The step of conditioning the surface of the processed sheet metal includes bringing the at least one surface conditioning member into engagement with the surface of the sheet metal. The surface conditioning member is brought into engagement with the surface in a manner to remove substantially all of the hematite layer and magnetite layer from the surface. Additionally, the surface conditioning member is brought into engagement with the surface in a manner to remove some but not all of the wustite layer from the surface, so that a portion of the wustite layer remains bonded to the base metal substrate of the processed sheet metal. The coating of the pre-painting or coil coating process is then bonded primarily to the wustite layer.

In another aspect of the invention, methods of removing iron oxide scale from processed sheet metal comprise the steps of: providing a surface conditioning apparatus having at least one rotating conditioning member; and conditioning a surface of the processed sheet metal with the surface conditioning apparatus. The step of conditioning the surface of the processed sheet metal includes bringing the at least one rotating conditioning member into engagement with the surface of the sheet metal. The rotating conditioning member is brought into engagement with the surface in a manner to remove some, but less than substantially all of the iron oxide scale from the surface so that a layer of oxide scale remains bonded to a base metal substrate of the processed sheet metal. Additionally, the rotating conditioning member is brought into engagement with the surface in a manner to reduce an arithmetic mean of distances of departure of peaks and valleys on the surface, measured from a mean center line, to less than 50 micro inches. The conditioned surface of the sheet metal is then coated according to any known method of coating, such as pre-painting or coil coating.

While the principal advantages and features of the present invention have been described above, a more complete and thorough understanding and appreciation of the invention may be attained by referring to the Figures and detailed description of the preferred embodiments, which follow.

BRIEF DESCRIPTION OF THE DRAWINGS

The accompanying Figures, which are incorporated in and form a part of the specification, illustrate exemplary embodiments of the present invention and, together with the description, serve to explain the principles of the invention.

Figure 1:
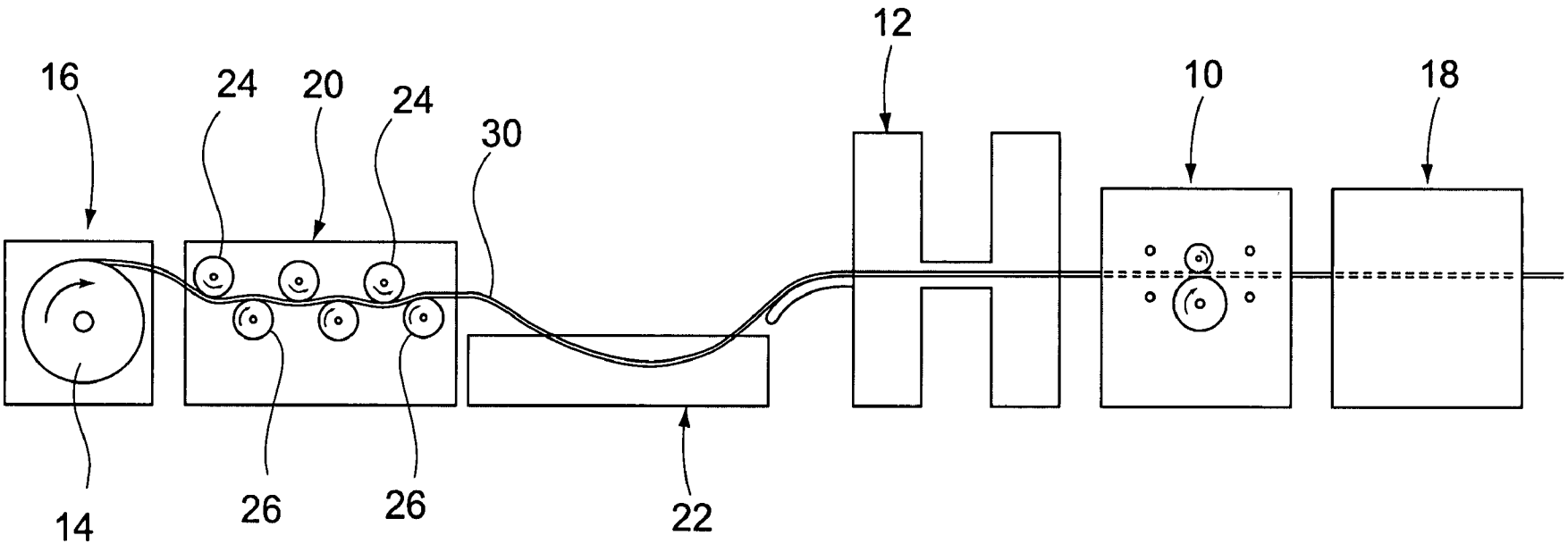
FIG. 1 is a schematic representation of an in-line metal processing system incorporating a stretcher leveler, a surface conditioning apparatus, and a coating apparatus of the type used in practicing the methods of the present invention.

Reference characters shown in these Figures correspond to reference characters used throughout the following detailed description of the preferred embodiments.

DETAILED DESCRIPTION OF THE PREFERRED EMBODIMENTS

In performing the methods of the present invention, a surface conditioning apparatus, which will be described in detail hereinafter, may be used in conjunction with a number of different machines for flattening and leveling sheet metal, and with a number of apparatus for coating sheet metal without departing from the scope of the present invention.

Figure 4:
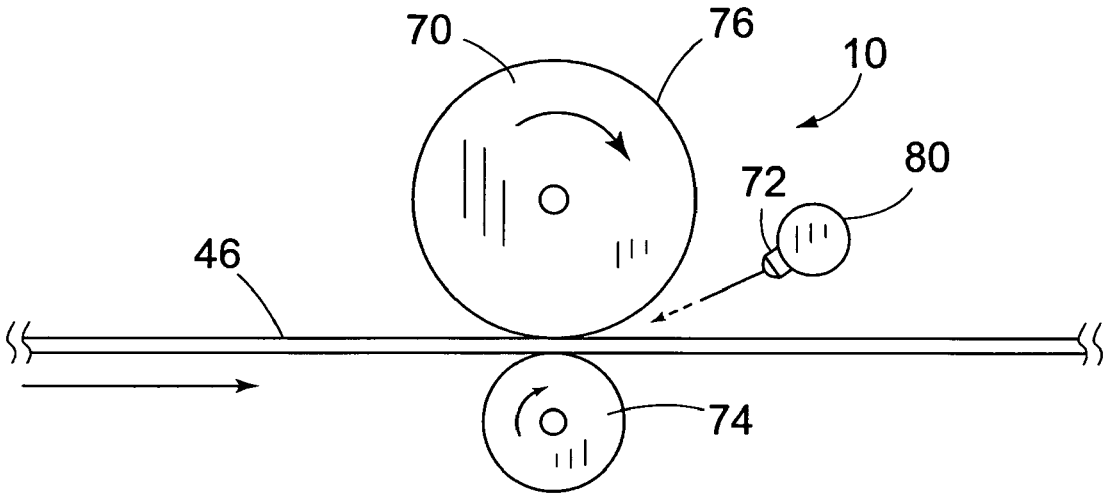
FIG. 4 is a side elevational view of a portion of a surface conditioning apparatus of the type used in practicing the methods of the present invention.
Figure 5:
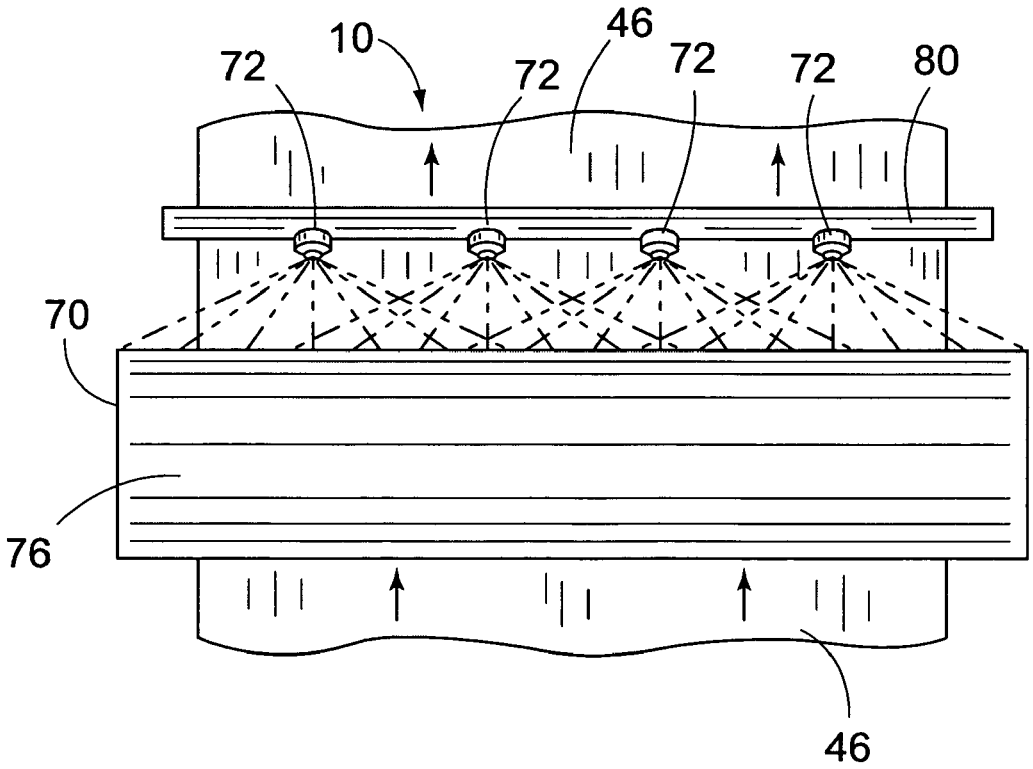
FIG. 5 is a top plan view of a portion of a surface conditioning apparatus shown in FIG. 4.

A surface conditioning apparatus of the type used in practicing the methods of the present invention is represented generally in FIG. 1 by the reference numeral 10. FIG. 1 is a schematic representation of an in-line metal processing system incorporating the surface conditioning apparatus 10, a stretcher leveler 12, a coating apparatus 18, and other components used therewith. Viewed from left to right, FIG. 1 shows a coil of sheet metal 14 mounted on an upstream pay-off reel 16, a straightener 20, a take up pit 22, the stretcher leveler 12, the surface conditioner 10, and the coating apparatus 18. The straightener 20 is positioned just downstream of the reel 16 and includes a plurality of upper rollers 24 and lower rollers 26 having a relatively large diameter, which are positioned relative to one another to put a deep reverse bend in the sheet 30 sufficient to reverse coil set, as is well known in the art. The take up pit 22 is positioned just downstream of the straightener 20, and the stretcher leveler 12 is just downstream of the take up pit. The strip 30 is advanced incrementally through the stretcher leveler 12 for successive stretching operations, as is known in the art, and the take up pit 22 is positioned at the exit end of the straightener 20 to take up slack in the continuously advancing strip 30 exiting the straightener as the strip 30 is advanced incrementally through the stretcher 12. As described more fully in U.S. Pat. No. 6,205,830 owned by the Applicant herein, the stretcher leveler 12 includes a clamping mechanism that clamps down on a segment of the strip 30 and stretches that segment beyond its yield point to eliminate internal residual stresses, thereby leveling that segment. As explained in U.S. Pat. No. 6,205,830, stretcher leveling is a desirable method of leveling sheet metal because it eliminates virtually all internal residual stresses and achieves superior flatness. With continued reference to FIG. 1, the surface conditioning apparatus 10 is positioned just downstream of the stretcher leveler 12. As shown in FIGS. 4 and 5, and as explained below in much more detail, the surface conditioning apparatus 10 includes at least one mildly abrasive, rotating cleaning brush, which is brought into engagement with a surface of the sheet metal strip 30 to remove scale and other smut from the surface. Thus, FIG. 1 depicts one preferred environment for practicing the methods of the present invention, wherein the surface conditioning apparatus 10 is used in conjunction with a stretcher leveler 12 and a coating apparatus 18. However, again, it should be understood that, in performing the methods of the present invention, the surface conditioning apparatus 10 may be used in conjunction with a number of other machines for flattening and leveling sheet metal and applying a protective coating to the sheet metal, without departing from the scope of the present invention.

Figure 2:
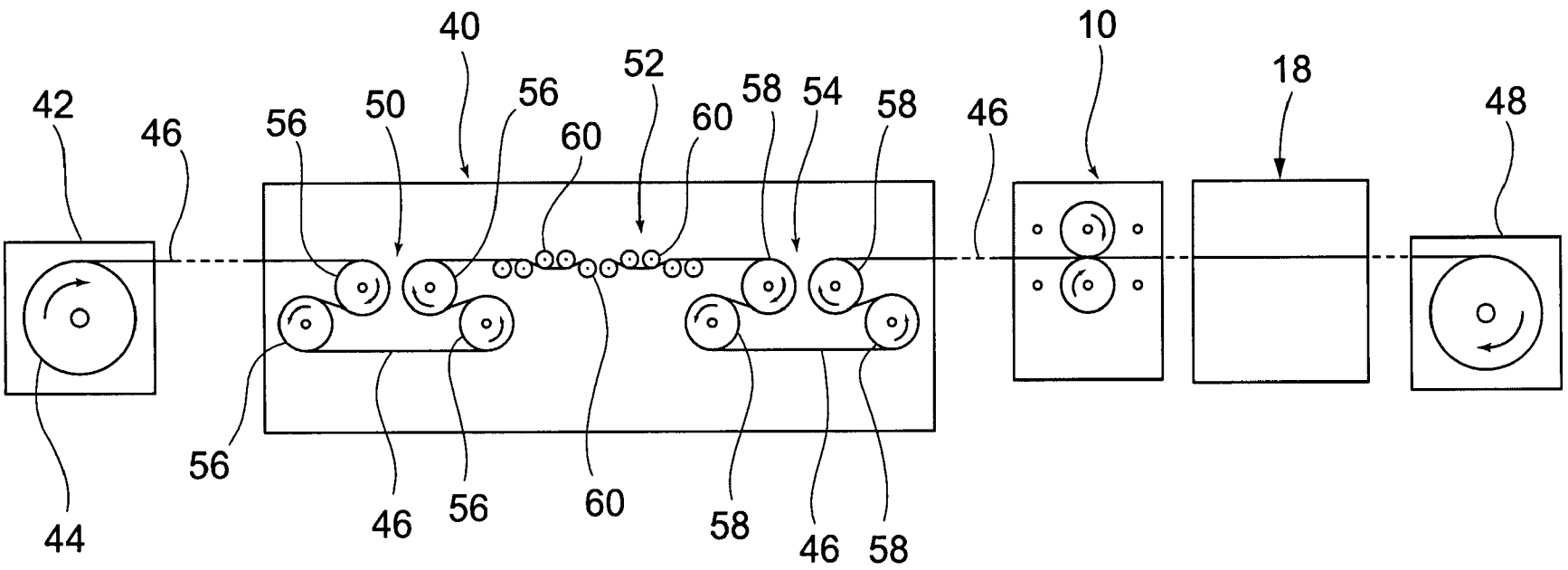
FIG. 2 is a schematic representation of an in-line metal processing system comprising a tension leveler, a surface conditioning apparatus, and a coating apparatus of the type used in practicing the methods of the present invention.

FIG. 2 is a schematic representation of an in-line metal processing system wherein the surface conditioning apparatus 10 is used in conjunction with a tension leveler 40 and a coating apparatus 18. Viewed from left to right, FIG. 2 shows an upstream pay-off reel 42, a coil 44 of sheet metal 46 mounted to the reel 42, the tension leveling apparatus 40, the surface conditioning apparatus 10, the coating apparatus 18, and a downstream take-up reel 48. In general, the tension leveling apparatus 40 comprises a drag bridle 50, a leveler 52, and a pull bridle 54, as is known in the art. The drag bridle 50 includes a plurality of drag rollers 56, which receive the metal sheet 46 from the upstream reel 42. The pull bridle 54 includes a plurality of pull rollers 58. The rollers of the drag and pull bridles 50 and 54 are powered, as is well known in the art, and rotate to advance the metal sheet through the tension leveler 40. The leveler 52 is located between the drag and pull bridles 50 and 54 and includes a plurality of smaller radius leveling rollers 60, which are offset from one another to impart bending stresses in the metal sheet 46 as the sheet is advanced therethrough. The pull rollers 58 of the pull bridle 54 turn slightly faster than the drag rollers 56 of the drag bridle 50. Thus, the portion of the metal sheet 46 between the drag and pull bridles 50 and 54 is placed under a substantial tensile force. As is known in the art, this tensile force is preferably sufficient to stretch all fibers in the metal sheet 46 to exceed the material yield point as the metal sheet 46 is made to conform to the smaller radius of the leveling rollers 60 located between the drag and pull bridles 50 and 54, as the metal sheet 46 passes through the leveling rollers 60. With continued reference to FIG. 2, the surface conditioning apparatus 10 (explained below in much greater detail) is positioned just downstream of the tension leveler 40. Thus, FIG. 2 depicts another preferred environment for practicing the methods of the present invention, wherein the surface conditioning apparatus 10 is used in conjunction with a tension leveler 40 and a coating apparatus 18. Tension leveling is also a preferred method of leveling sheet metal because of its ability to achieve an extremely flat condition of the sheet metal in a continuous coil-to-coil operation, substantially free of coil set and other deformities caused by internal residual stresses. But again, it should be borne in mind that, in performing the methods of the present invention, the surface conditioning apparatus 10 may be used in conjunction with other machines for flattening and leveling sheet metal and apply to a protective coating to the sheet metal, without departing from the scope of the present invention.

Figure 3:
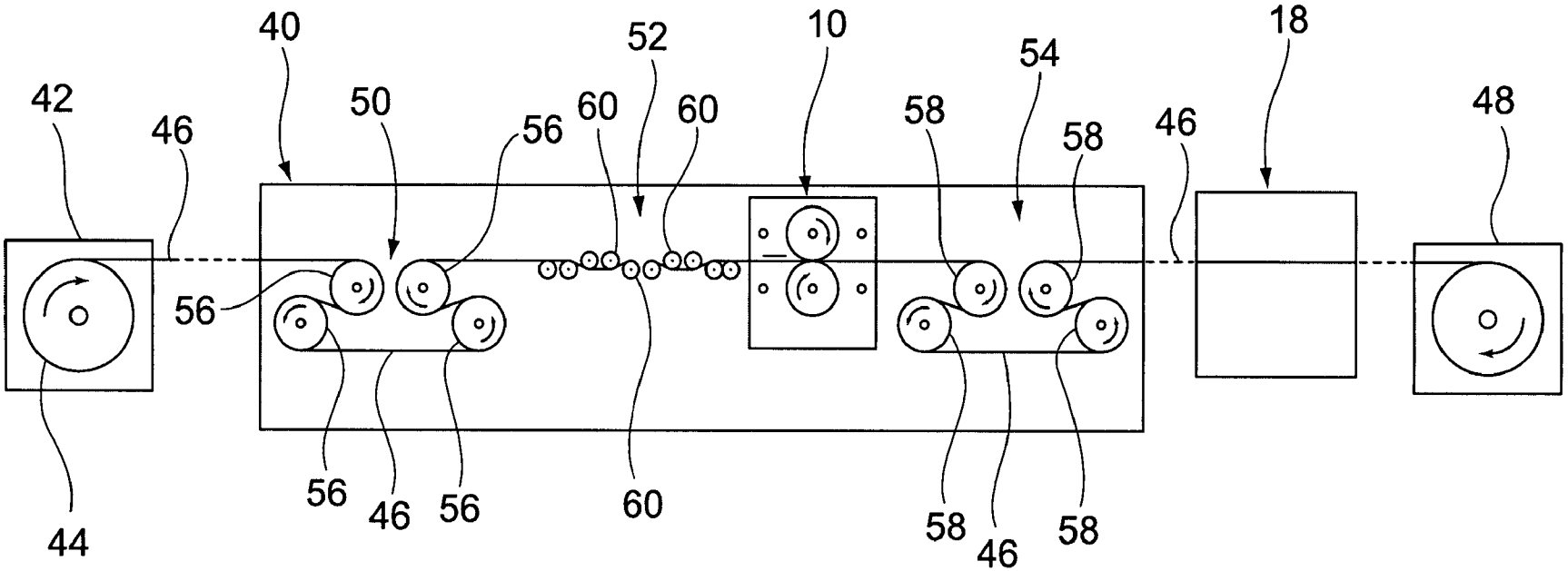
FIG. 3 is a schematic representation of another embodiment of an in-line metal processing system comprising a tension leveler, a surface conditioning apparatus, and a coating apparatus of the type used in practicing the methods of the present invention.

FIG. 3 is a schematic representation of still another in-line metal processing system in which the methods of the present invention may be practiced. Like the system depicted in FIG. 2, the system of FIG. 3 shows the surface conditioning apparatus 10 used in conjunction with the tension leveler 40 and a coating apparatus 18, but in this embodiment the surface conditioning apparatus 10 is positioned between the leveler portion 52 and the pull bridle 54 of the tension leveler 40, rather than downstream of the pull bridle 54 as shown in FIG. 2. Aside from the location of the surface conditioning apparatus 10 relative to the components of the tension leveler 40, the embodiment of FIG. 3 is generally similar to the embodiment of FIG. 2. When the surface conditioning apparatus 10 is located between the leveling rollers 60 and the pull bridle 54, the surface conditioning apparatus 10 engages the metal sheet 46 (in a manner described hereinafter) while the metal sheet 46 is subjected to the tensile force between the drag and pull bridles 50 and 54. While under this tension, the metal sheet 14 is in an extremely flat condition, which allows for best performance of the surface conditioning apparatus 10. However, once again, the system depicted in FIG. 3 is intended to illustrate another preferred environment in which the methods of the present invention may be practiced. Certainly, other sheet metal flattening and leveling machines could be used in connection with the surface conditioning apparatus 10 to perform the methods claimed herein, without departing from the scope of the present invention.

FIG. 4 is an enlarged view of certain key components of the surface conditioner 10, and FIG. 5 is a top plan view of certain key components of the surface conditioner 10. As shown in FIGS. 4 and 5, the surface conditioner 10 includes a rotating cleaning brush 70, a plurality of coolant/lubricant sprayers 72, and a back-up roller 74. The cleaning brush 70 includes a mildly abrasive conditioning surface 76 having a generally cylindrical configuration.

It has been found that cleaning brushes manufactured by Minnesota Mining and Manufacturing (3M) under the name Scotch-Brite®, or their equivalent, are suitable for use in the surface conditioner 10 of the present invention. In these brushes, abrasive particles are bonded to resilient synthetic (e.g., nylon) fibers of the brush with a resin adhesive. The resilient brush fibers of the Scotch-Brite® product are of an open-web construction, which gives the fibers a spring-like action that conforms to irregular surfaces and prevents surface gouging. Scotch-Brite® brand cleaning brushes are available in a variety of grades of coarseness and fiber density, though suitable abrasive and non-abrasive cleaning brushes manufactured by others could be used without departing from the scope of the present invention. The inventor has determined that 3M's Scotch-Brite® brand finishing-cleaning brushes identified by 3M item number #048011-90626-3, SPR 22293A are suitable for use in practicing the methods of the present invention, though other brushes with other grades of coarseness and fiber density may also be suitable. The selection of other suitable brushes would be within the skill of one of ordinary skill in the art.

As shown in FIG. 4, the cleaning brush 70 is preferably positioned above the sheet metal strip 46 for engagement with a surface thereof. Preferably, the cleaning brush 70 is rotated in a direction against the movement of the strip through the surface conditioner 10 (clockwise as viewed in FIG. 4, with the strip 46 advancing from left to right). The back-up roller 74 engages against the opposite surface of the strip 46 and applies a force equal and opposite to the downward force applied by the cleaning brush 70. Preferably, the back-up roller 74 moves in the same direction as the strip 46 (clockwise as viewed in FIG. 4). The back-up roller 74 may be powered to assist in advancing the strip 46 through the surface conditioner 10. It should be understood, however, that although FIGS. 4 and 5 depict only one cleaning brush 70 positioned for engagement with a top surface of the strip 46, additional brushes positioned for engagement with the upper and/or lower surfaces of the strip may be used without departing from the scope of the invention.

Preferably, a spray bar 80 having a plurality of sprayer nozzles 72 is positioned just downstream of the cleaning brush 70, with the sprayer nozzles 72 aimed generally toward the point of engagement of the cleaning brush 70 and the surface of the strip 46. The sprayer nozzles 72 apply a coolant/lubricant, such as water, to the cleaning brush 70 during operation of the surface conditioner 10. Preferably, the coolant/lubricant is applied at the rate of about 4 to 6 gallons per minute per 12" length of the cleaning brush 70. This enhances performance of the surface conditioner 10 by producing a cooler running operation, while washing away cleaning by-products (scale and smut removed by the abrasive surface of the brush), and by extending the life of the cleaning brush 70. As shown in FIG. 5, the spray nozzles 72 are preferably positioned to apply the coolant/lubricant in an overlapping spray pattern so that, if one of the nozzles gets plugged, adjacent nozzles can maintain substantially complete coverage. While the spray bar 80 positioned just downstream of the cleaning brush 70 is important for proper performance, additional spray bars (not shown) may be added at other locations upstream and downstream of the cleaning brush 70 and back-up roller 74.

For optimum performance, the surface conditioner 10 requires a very flat surface. This is why the stretcher leveling machine 12 and tension leveling machines 40 shown in FIGS. 1–3 and described above are preferred. However, again, assuming a sufficiently flat surface can be achieved, other sheet metal flattening and leveling machines can be used in connection with the surface conditioning apparatus 10 to perform the methods of the present invention claimed herein.

Figure 6:
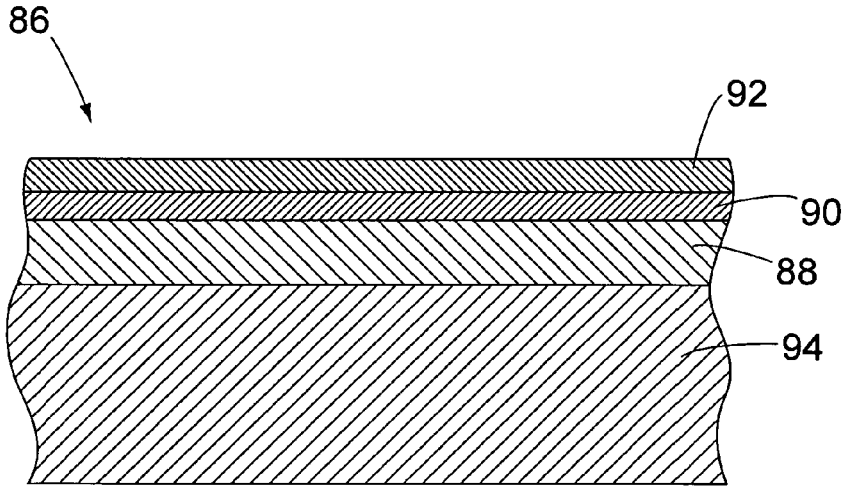
FIG. 6 is a fragmented cross-sectional view of a length of processed sheet metal with layers of iron oxide scale, prior to surface conditioning according to the methods of the present invention.

Preferably, the various apparatus an environments described above are used to practice the present invention, which includes methods of removing iron oxide scale from processed sheet metal. FIG. 6 depicts a section of processed sheet metal 86 (e.g., hot rolled carbon steel) with layers of iron oxide scale on the surface, prior to surface conditioning according to the methods of the present invention. As shown in FIG. 6, the iron oxide scale generally comprises three layers: a wustite layer 88, a magnetite layer 90, and a hematite layer 92. The wustite layer 88 is bonded to a base metal substrate 94 of the processed sheet metal. The magnetite layer 90 is bonded to the wustite layer 88, and the hematite layer 92 is bonded to the magnetite layer 90. Note that the various layers shown in FIG. 6 are depicted in a manner that is easy to view; but FIG. 6 is not necessarily to scale. As explained above, in hot rolled carbon steel cooled from finishing temperatures above 1058° F. (570° C.), the oxide layer will typically comprise at least 50% wustite, as well as some magnetite and hematite, with the overall thickness of these three layers being about 0.5% of the total thickness of the steel sheet. Thus, for example, in ⅜" hot rolled carbon steel, the overall thickness of the oxide layer will be about 0.002".

Figure 7:
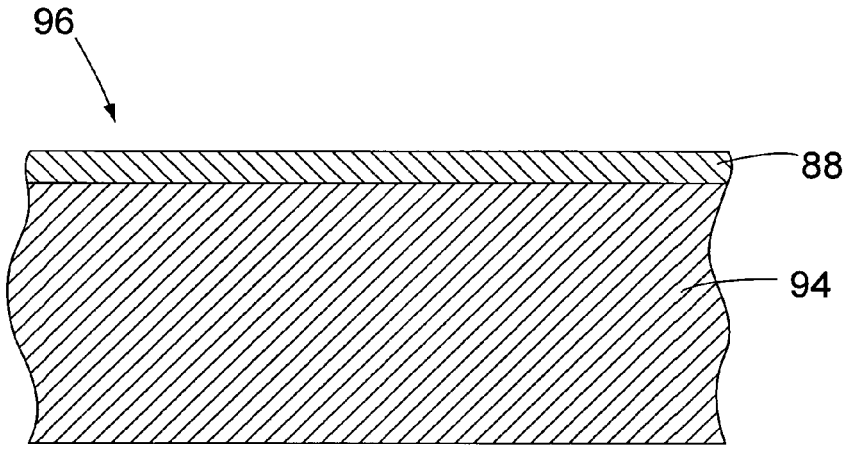
FIG. 7 is a fragmented cross-sectional view of a length of processed sheet metal after it has been surface conditioned according to the methods of the present invention.
Figure 8:
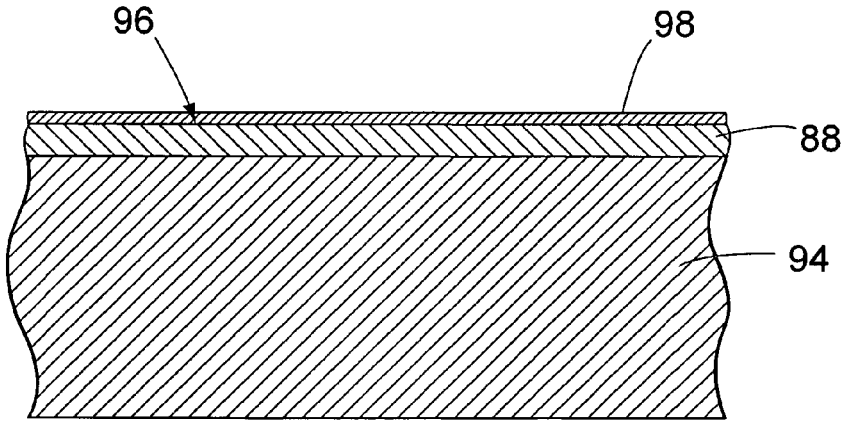
FIG. 8 is a fragmented cross-sectional view of a length of the conditioned sheet metal after it has been coated.

In general, a method of the present invention comprises conditioning a surface of the processed sheet metal 46 with the surface conditioning apparatus 10 by bringing the generally cylindrical conditioning surface 76 of the rotating cleaning brush 70 into engagement with the surface of the sheet metal 46. As the sheet metal 46 is advanced through the surface conditioning apparatus 10, the rotating cleaning brush 70 is rotated in the upstream direction against the downstream advancement of the length of sheet metal 46. This engagement of the brush 70 against the surface of the sheet metal 46 removes substantially all of the hematite layer 92 and magnetite layer 90 from the surface. In addition, the engagement of the brush 70 against the surface of the sheet metal 46 removes some (but not all) of the wustite layer 88 from the surface, so that a portion of the wustite layer 88 remains bonded to the base metal substrate 94 of the processed sheet metal, as shown in FIG. 7, which depicts a section of processed sheet metal 96 following surface conditioning according to the methods of the present invention. As with FIG. 6, note that the layers shown in FIG. 7 are not to scale. Again, in hot rolled carbon steel cooled from finishing temperatures above 1058° F. (570° C.), the overall thickness of the three oxide layers prior to surface conditioning in accordance with the present invention is about 0.5% of the total thickness of the steel sheet, and after surface conditioning in accordance with the present invention, the thickness of the remaining wustite layer 88 is much less than 0.5% of the total thickness. Preferably, at least 10% of the wustite layer 88 is removed from the surface of the sheet metal 46. More preferably, conditioning the surface of the processed sheet metal in this manner removes between 10% and 50% of the wustite layer 88 from the surface of the sheet metal 46. Even more preferably, the step of conditioning is performed in a manner to remove about 30% of the wustite layer 88 from the surface of the sheet metal 46, leaving a remaining layer of wustite. Limited research has shown that the remaining layer of wustite measures no more than about 0.001 inches in average thickness, but which preferably measures between about 0.00035 inches and 0.00085 inches in average thickness. Even more preferably, the remaining layer of wustite measures about 0.00055 inches in average thickness.

The hematite layer 92 and magnetite layer 90 are rather brittle, so the above-described mechanical brushing is very effective at removing all or substantially all of these layers. The removal of these layers has been confirmed by a napkin wipe test (e.g., wiping a napkin across the surface), which is considered standard process control. Once the surface has been conditioned in accordance with the methods of the present invention, a napkin wiped across the surface should not pick up any visually perceptible scale or smut. Also, as indicated above, this mechanical brushing also preferably removes about 30% of the tightly adhered wustite layer 88 from the surface of the sheet metal 46, leaving a layer of wustite bonded to the base metal substrate 94. It has been found that the remaining layer of wustite 88 is beneficial because it allows the conditioned surface of the sheet metal to withstand further oxidation. Limited research by the inventors herein has shown that this benefit occurs at least in part as a result of the mechanical brushing removing all or substantially all of the magnetite and hematite composition layers. With these layers removed, there is less available free iron to form a "red rust" oxide. Magnetite (chemically known as $Fe_3O_4$) and hematite (chemically known as $Fe_2O_3$) contain much more available iron atoms than the remaining wustite layer (chemically known as FeO). It is also theorized that the process of mechanical brushing has a "smearing" effect on the remaining wustite layer, which may contribute to the sheet metal's ability to withstand further oxidation by making the remaining wustite layer more uniform and thereby reducing the likelihood of ambient oxygen and moisture reaching the base metal substrate 94. However, this theory has not been confirmed.

In another aspect of the present invention, a method of removing iron oxide scale from processed sheet metal comprises the steps of: providing a surface conditioning apparatus 10 having at least one rotating conditioning brush 70; and conditioning a surface of the processed sheet metal 46 by bringing the rotating conditioning brush 70 into engagement with the surface of the sheet metal 46 in a manner to remove some, but less than substantially all of the iron oxide scale from the surface so that a layer of wustite 88 remains bonded to a base metal substrate 94, and in a manner to smooth the surface. Preferably, the "smoothing" achieved by engagement of the rotating conditioning brush 70 with the surface of the sheet metal 46 is sufficient to reduce an arithmetic mean of distances of departure of peaks and valleys on the surface, measured from a mean center line, to less than 50 micro inches. More preferably, the smoothing achieved by the rotating conditioning brush 70 is sufficient to reduce the arithmetic mean of the distances of departure of peaks and valleys on the surface, measured from the mean center line, to between about 35 and 45 micro inches.

Surface roughness is measured with a profilometer, as is well known in the art, and is usually expressed as an "Ra" value in micro meters or micro inches. This Ra value represents the arithmetic mean of the departure of the peaks and valleys of the surface profile from a mean center line over several sampling lengths, and is therefore also sometimes referred to as a "center line average" (CLA). The lower the Ra value, the smoother the surface finish. Limited quantitative evidence exists demonstrating that hot rolled sheet metal surface conditioned in accordance with the methods of the present invention, as measured with a profilometer, has a lower (i.e., better) Ra value than that of typical hot rolled steel which has been pickled. In fact, limited research has shown that hot rolled sheet metal surface conditioned in accordance with the methods of the present invention has an Ra value that is comparable to or better than cold roll regular matte finish (which typically has an Ra value of between 40 and 60 micro inches).

The inventors herein have found that the surface of the remaining wustite layer 88 left by mechanical brushing in accordance with the present invention is relatively smooth (as indicated by the Ra values noted above) and requires minimal or no additional surface preparation prior to painting or other coating. It has been found that the painting characteristics of material surface conditioned in accordance with the present invention are as good or better than pickled material. To the eye, the surfaces are virtually indistinguishable, as both appear to be free of oxide scale. However, testing has shown that, over time, material surface conditioned in accordance with the present invention is better suited to resist further oxidation than similar material that has been picked and oiled. Independent "salt spray tests" (which are standard in the industry) were conducted by Valspar Corporation, a reputable industrial paint manufacturer, and material that was stretcher leveled and then surface conditioned in accordance with the present invention was found to be substantially corrosion free after as long as 1000 hours of salt spray testing, whereas hot rolled steel that was pickled and oiled showed signs of further corrosion after as little as 144 hours of salt spray testing.

Again, it has been found that the layer of wustite 88 remaining after mechanical brushing in accordance with the methods of the present invention is beneficial because it inhibits further oxidation, due at least in part to the removal of all or substantially all of the magnetite and hematite composition layers, which leaves less available free iron to form "red rust" oxide. But in addition to this, and in addition to the smoothness benefits described above, mechanical brushing in accordance with the methods of the present invention is preferable to pickling and oiling because there is no need to remove the oil before coating; hydrochloric acid (an environmentally hazardous chemical that has special storage and disposal restrictions) is not used; and there is no oil to interfere with manufacturing processes, such as welding.

The removal of the iron oxide and the exposing of the wustite layer 88 on the surface of the sheet metal according to the method described above prepares the sheet metal for further processing in a manner that is less expensive than prior art methods of preparing sheet metal. The preparation of the sheet metal by exposing the wustite layer 88 eliminates the prior art pickling and oiling steps needed to remove oxide and protect the exposed metal before further processing. The exposing of the wustite layer also eliminates the need to remove the oil residue from the sheet metal prior to further processing, such as painting or galvanizing. Eliminating the pickling and oiling steps and the need to subsequently remove the oil for further coating of the sheet metal reduces the costs of subsequently coating the sheet metal from which the iron oxide scale has been removed.

Each of drawing FIGS. 1, 2, and 3 show a representation of a further processing step of the sheet metal 46 from which iron oxide scale has been removed by the method of the invention. In FIGS. 1, 2, and 3, a coating apparatus 18 is represented schematically. Various methods of coating metal are known in the prior art, for example pre-painting and coil coating and it is intended that the schematic representation of the coating apparatus 18 shown in FIGS. 1, 2, and 3 represent each of these known types of apparatus for coating metal.

The coating apparatus 18 can perform either a "batch" method of coating steel, or can perform the continuous coating process on the steel in which continuous sheet steel is directed through rolls coating both sides of the sheet with a liquid or powder coating in the apparatus 18 at a high speed, for example 600 feet per minute.

The coating apparatus 18 receives the metal from which iron oxide scale has been removed by the conditioning apparatus 10 of the invention according to the earlier described method of the invention. The sheet metal 46 with the layer of wustite 88 exposed is received by the coating apparatus 18. The coating apparatus 18 applies a pre-paint coating 98 to the steel 46 by any known method, for example the roll coating method. This provides a uniform coating on the steel surfaces and also smoothes the surfaces improving their appearance. Following the application of the coating, the coated steel can be further processed by passing it through a furnace, for example, to bake the coating to the surfaces and then is cooled with air and water. The sheet could also receive two coats, passing the sheet again through coating rollers and an oven.

As stated earlier, various different methods of coating steel are known, and it is intended that the coating apparatus 18 schematically shown represent those known methods of coating steel. These known methods are combined with the novel method of removing iron oxide scale from steel in the subject matter of the invention.

In view of the foregoing, it will be seen that the several advantages of the invention are achieved and attained. The embodiments were chosen and described in order to best explain the principles of the invention and its practical application to thereby enable others skilled in the art to best utilize the invention in various embodiments and with various modifications as are suited to the particular use contemplated. However, as various modifications could be made in the invention described and illustrated without departing from the scope of the invention, it is intended that all matter contained in the foregoing description or shown in the accompanying Figures shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A method of removing iron oxide scale from sheet metal and further coating the sheet metal, wherein the iron oxide scale generally comprises a wustite layer that is bonded to a base metal substrate of the sheet metal, a magnetite layer that is bonded to the wustite layer, and a hematite layer that is bonded to the magnetite layer, the method comprising the steps of:

providing a surface conditioning apparatus having at least one surface conditioning member;

conditioning a surface of the sheet metal with the surface conditioning apparatus by bringing the at least one surface conditioning member into engagement with the surface of the sheet metal in a manner to remove substantially all of the hematite and magnetite layers from the surface, and in a manner to remove less than substantially all of the wustite layer from the surface so that a portion of the wustite layer remains bonded to the base metal substrate of the sheet metal; and applying a coating layer to the portion of the wustite layer that remains bonded to the base metal substrate of the sheet metal by pre-painting the sheet metal.

2. The method of claim 1 wherein the step of conditioning the surface of the sheet metal includes removing at least 10% of the wustite layer from the surface of the sheet metal before applying the coating layer.

3. The method of claim 1 wherein the step of conditioning the surface of the sheet metal includes removing between 10% and 50% of the wustite layer from the surface of the sheet metal before applying the coating layer.

4. The method of claim 1 wherein the step of conditioning the surface of the sheet metal includes removing an amount of the wustite layer from the surface so that a remaining layer of wustite measures no more than about 0.001 inches in average thickness.

5. The method of claim 1 wherein the at least one surface conditioning member is a rotating conditioning member having a generally cylindrical conditioning surface, and wherein the step of conditioning the surface of the sheet metal with the surface conditioning apparatus includes bringing the generally cylindrical conditioning surface of the rotating conditioning member into engagement with the surface of the sheet metal.

6. The method of claim 5 wherein the at least one rotating conditioning member comprises a brush having a plurality of resilient fibers.

7. The method of claim 1 further comprising pre-painting the sheet metal by a batch process.

8. The method of claim 1 further comprising pre-painting the sheet metal by continuous coil coating.

9. A method of removing iron oxide scale from sheet metal and coating the sheet metal, wherein the iron oxide scale generally comprises a wustite layer that is bonded to a base metal substrate of the sheet metal, a magnetite layer that is bonded to the wustite layer, and a hematite layer that is bonded to the magnetite layer, the method comprising the steps of:

providing a surface conditioning apparatus having at least one rotating conditioning member with a generally cylindrical conditioning surface; and conditioning a surface of the sheet metal with the surface conditioning apparatus by bringing the generally cylindrical conditioning surface of the at least one surface conditioning member into engagement with the surface of the sheet metal in a manner to remove substantially all of the hematite and magnetite layers from the surface, and in a manner to remove less than substantially all of the wustite layer from the surface so that a portion of the wustite layer remains bonded to the base metal substrate of the sheet metal; and applying a coating to the portion of the wustite layer remaining bonded to the base metal substrate of the sheet metal.

10. The method of claim 9 wherein the step of conditioning the surface of the sheet metal includes bringing the generally cylindrical conditioning surface of the at least one surface conditioning member into engagement with the surface of the sheet metal in a manner to reduce an arithmetic mean of distances of departure of peaks and valleys on the surface, measured from a mean center line, to less than 50 micro inches.

11. The method of claim 9 further comprising applying the coating by a batch pre-paint process.

12. The method of claim 9 further comprising applying the coating by continuous coil coating.

13. A method of removing rust from sheet metal surfaces and coating the surfaces, where the rust generally comprises a wustite layer bonded to the sheet metal surface, a magnetite layer bonded to the wustite layer, and a hematite layer bonded to the magnetite layer, the method comprising:

providing a surface conditioning apparatus having a surface conditioning member;

conditioning the surface of the sheet metal with the surface conditioning apparatus by the surface conditioning member removing substantially all of the hematite layer and the magnetite layer from the surface so that a portion of the wustite layer remains bonded to the sheet metal surface; and, then coating the sheet metal surface to apply a pre-paint to the portion of the wustite layer and the sheet metal surface.

14. The method of claim 13 further comprising coating the sheet metal surface by batch pre-painting the sheet metal surface.

15. The method of claim 13 further comprising coating the sheet metal surface by continuous coil coating the sheet metal surface.

16. The method of claim 13 further comprising removing at least 10% of the wustite layer from the sheet metal surface before coating the sheet metal surface.

17. The method of claim 13 further comprising removing an amount of the wustite layer so that the portion of the wustite layer remaining bonded to the sheet metal surface measures no more than about 0.001 inches in average thickness.

* * * * *